United States Patent [19]

Hammer et al.

[11] Patent Number: 4,562,381

[45] Date of Patent: Dec. 31, 1985

[54] STARTING CIRCUIT FOR MULTIPLE FLUORESCENT LAMPS

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 650,033

[22] Filed: Sep. 13, 1984

Related U.S. Application Data

[63] Continuation of Ser. No. 599,607, Apr. 16, 1984, abandoned, which is a continuation of Ser. No. 460,718, Jan. 24, 1983, abandoned, which is a continuation-in-part of Ser. No. 313,877, Oct. 22, 1981, abandoned.

[51] Int. Cl.[4] ..... H05B 39/00

[52] U.S. Cl. ..... 315/99; 315/103; 315/185 R; 315/188; 315/290; 315/323

[58] Field of Search ..... 315/99, 103, 185, 188, 315/290, 323

[56] References Cited

U.S. PATENT DOCUMENTS

| | | | |
|---|---|---|---|
| 2,286,790 | 6/1942 | Dench | 315/96 |
| 2,507,101 | 5/1970 | Hall | 315/96 |
| 2,650,278 | 8/1953 | Foulke | 315/101 |
| 2,965,799 | 12/1960 | Brooks | 315/282 |
| 3,924,155 | 12/1975 | Vogeli | 315/105 |
| 4,207,497 | 6/1980 | Capewell | 315/96 |
| 4,253,043 | 2/1981 | Chermin et al. | 315/101 |

FOREIGN PATENT DOCUMENTS

| | | |
|---|---|---|
| 589571 | 6/1947 | United Kingdom . |
| 777566 | 6/1957 | United Kingdom . |

OTHER PUBLICATIONS

"Fluorescent Lamps and Lighting", by Elenbaas et al., Phillips Technical Library, 1962, pp. 96, 97.

*Primary Examiner*—Harold Dixon

*Attorney, Agent, or Firm*—N. D. Herkamp; Philip L. Schlamp; Fred Jacob

[57] ABSTRACT

Two or more fluorescent lamps having a total length of about 96 inches and each having a diameter of one and a half inches and consuming less than 10 watts power per foot of length are connected in electrical series combination, one cathode of each lamp being connected to that of another lamp. An end of each remaining cathode of the combination is respectively connected to one of a pair of input electrical power terminals for a 50 or 60 hertz a-c line voltage in the range of 200 to 300 volts, one of the latter connections being via a ballast inductor. A starter switch is connected across the other ends of the remaining cathodes, and a secondary winding on the ballast inductor is connected across the interconnected cathodes. The lamp designs are specified such that they will start and operate in the circuit from the a-c line voltage.

5 Claims, 1 Drawing Figure

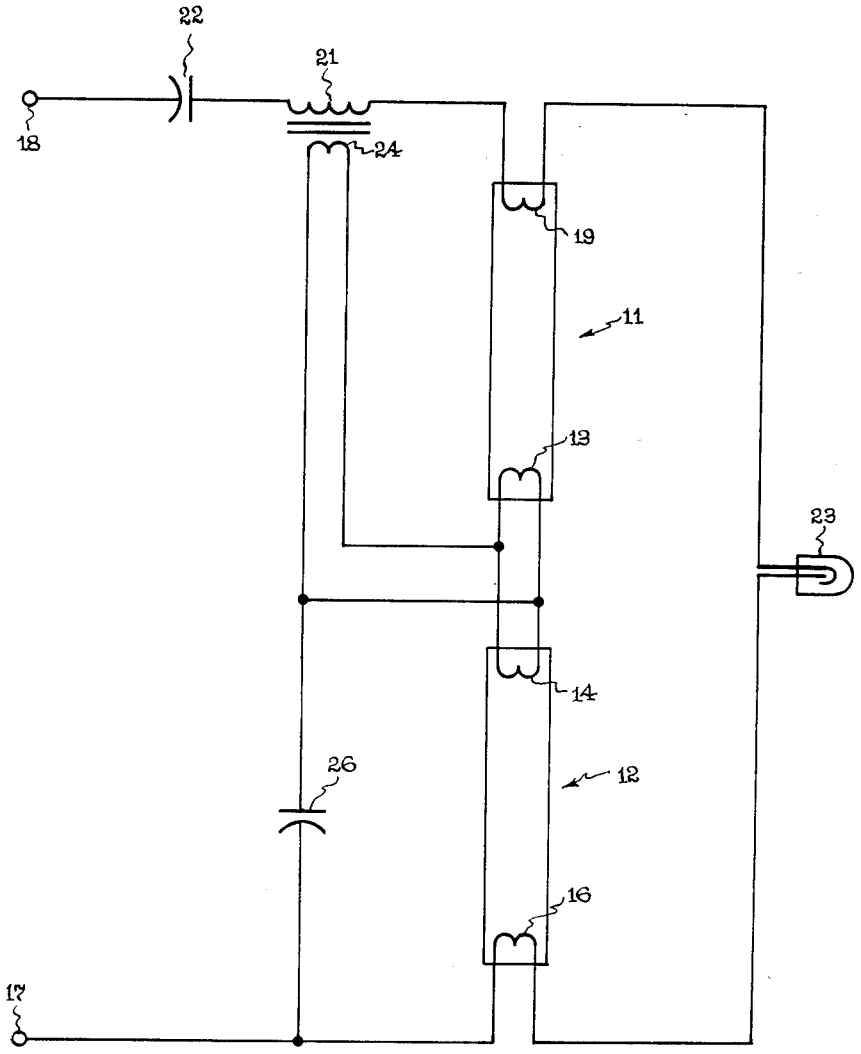
22
21
18
24
19
11
13
23
14
26
12
16
17

STARTING CIRCUIT FOR MULTIPLE FLUORESCENT LAMPS

CROSS-REFERENCE TO RELATED APPLICATIONS

This application is a continuation of application Ser. No. 599,607, filed Apr. 16, 1984 now abandoned, which is a continuation of application Ser. No. 460,718, filed Jan. 24, 1983, abandoned; which is a continuation-in-part of patent application Ser. No. 313,877, filed Oct. 22, 1981, abandoned.

BACKGROUND OF THE INVENTION

The invention is in the field of fluorescent lamp systems having one or more fluorescent lamps connected in electrical series with a ballast, for operation in the 200 to 300 volt range, such as standard values of 220, 240, or 277 volts.

Many fluorescent lamp systems have two lamps, usually positioned side-by-side, to provide more light from a larger source area than does a single lamp. Fluorescent lamps are manufactured in various different lengths, the 24-inch length and the 48-inch length being widely used in lighting systems. The voltage required for starting and operating fluorescent lamps increases approximately linearly with increased lamp length. Thus, a 48" lamp requires twice the voltage as a 24" lamp, two 24" lamps connected in series require essentially the same voltage as a single 48" lamp, and two 48" lamps in series require approximately twice the voltage as two 24" lamps in series.

A widely used type of fluorescent lamp circuit utilizes a voltage step-up transformer connected between the lamp(s) and the power line voltage supply, for providing suitable voltage to the lamp(s), such as is disclosed in U.S. Pat. No. 4,185,233 to Riesland et al. Another widely used fluorescent lamp circuit, which is more economical to manufacture, utilizes a current-limiting ballast impedance (such as an inductor, resistor, and/or capacitor) connected in series between the lamp(s) and the power line voltage source. The total length of the discharge path(s) of the lamp(s) in this circuit must be short enough so the lamp starting and operating voltages are sufficiently less than the line voltage. Therefore, such circuits have been limited to operating a single 24" (or shorter) fluorescent lamp from a 120-volt a-c line, and two 24" (or shorter) lamps connected in series (or a single 48" or shorter lamp) from a 220-volt, 240-volt, or 277-volt a-c line, the latter voltage being obtained from a 480-volt three-phase system. For convenience, these voltages are defined herein as being in a range of 200 to 300 volts.

It has been desirable to be able to have a lighting system employing a pair of 48-inch fluorescent lamps in series with a simple series ballast as shown in FIG. 1 for operation from a line voltage in the range of 200 to 300 volts, but this has not been achieved heretofore because of the higher voltage requirements of the 48-inch lamps as compared to the 24-inch lamps. Such a system, if it could be achieved, would provide about twice the light output of a 24-inch lamp system with a substantial increase in system efficacy at only a small increase in cost.

SUMMARY OF THE INVENTION

Objects of the invention are to provide a fluorescent lighting system having two series-connected 48-inch fluorescent lamps ballasted by a series-connected impedance and operable in the 200 to 300 volt range such as from a standard 220-volt, 240-volt, or 277-volt a-c line source of about 50 Hz or 60 Hz.

The invention comprises, briefly and in a preferred embodiment, a fluorescent lamp lighting system having at least two lamps with a total lamp length of about 96 inches, which can be provided by a pair of 48-inch lamps connected in electrical series. Ballast impedance means is connected in series combination with the lamps, and this combination is intended for operative connection to an a-c electrical power source in the range of about 200 to 300 volts at about 50 or 60 Hz. The lamp bulbs, preferably or glass, have outside diameters of about one and one-half inches and must be devoid of any internal conductive starting aid material therealong such as is commonly used in lamps containing krypton gas. The bulbs contain a small quantity of liquid mercury and a mixture of inert gases such as krypton and neon or argon in a volume ratio of about 80% to 20% at a pressure of about 1.5 torr. The lamps are of the cathode preheat type, designed to consume less than ten watts per foot of length. One cathode of each lamp is interconnected in parallel or series with that of the other lamp. An end of each remaining cathode of the combination is respectively connected to one of a pair of electrical power input terminals, one of the latter connections being via a ballast inductor. A starter switch is connected across the other ends of the remaining cathodes, and a secondary winding on the ballast inductor is connected across the interconnected cathodes. The circuit causes simultaneous starting of the lamps, with a single starter switch, on a line voltage of about 200 to 300 volts.

BRIEF DESCRIPTION OF THE DRAWING

The single FIGURE of the drawing is an electrical schematic diagram of a preferred embodiment of the invention.

DESCRIPTION OF THE PREFERRED EMBODIMENTS

As shown in the drawing, a plurality of fluorescent lamps 11, 12 are connected in series combination, one cathode 13 of lamp 11 being interconnected in electrical parallel with one cathode 14 of the other lamp 12. Alternatively, the cathodes 13, 14 can be interconnected in series. An end of the remaining cathode 16 of lamp 12 is connected to a terminal 17 of a pair of electrical power input terminals 17, 18 providing voltage at 50 or 60 hertz in a range of about 200 to 300 volts, and an end of the remaining cathode 19 of lamp 11 is connected to the input terminal 18 via a ballast comprising an inductor 21 and capacitor 22.

A starter switch 23 is connected across the remaining other ends of the cathodes 19, 16, and a secondary winding 24 on the ballast inductor 21 is connected in parallel with the interconnected cathodes 13, 14. A conventional starting capacitor 26 is connected across one of the lamps 12, for aiding the starting of the other lamp 11; when this lamp starts, the lamp 12 starts immediately.

The starter switch 23 may be of any suitable conventional type, such as a well-known glow-starter switch as represented in the drawing and comprising an envelope containing an ionizable gas such as argon or neon and a pair of normally open switch contacts of which one is a bimetal strip which deforms to close the contacts when heated by a glow discharge of the gas.

The circuit functions as follows. When suitable electrical a-c voltage in the range of about 200 to 300 volts is applied to the input terminals 17, 18, this voltage or a portion of it is applied across the contacts of the starter switch 23, via inductor 21 and cathodes 16, 19, causing a glow discharge in the starter gas between the electrodes, which heats the bimetal contact causing it to deflect and close the switch contacts. While the starter switch is closed, a current path is established through the inductor 21 and cathodes 16, 19. This current is a value, such as about 0.65 amperes, to "preheat" the cathodes 16, 19 to electron emissive temperature in a short time such as about one second. At the same time, current induced in the secondary winding 24 of the inductor 21 causes the cathodes 13, 14 to "preheat" in a short time, such as about one second, to electron emissive temperature. While the starter switch 23 contacts are closed, there cannot be a glow discharge therein, and the bimetal contact cools and reverts to its normally open position, thus opening the switch contacts whereupon the line a-c voltage is across the series-connected lamps 11, 12. As explained above, the starting capacitor 26 shunts the lamp 12 causing all or a large part of the line voltage to be across the lamp 11, causing a discharge current to flow in the lamp between its cathodes 13, 19 and the lamp lights in normal operating manner. As soon as the discharge occurs in lamp 11, the voltage across the lamp reduces and the lamp 12 starts immediately, in well-known manner. Thus both lamps appear to light simultaneously, in a pleasing manner as compared to a two-starter multiple lamp circuit which can cause the lamps to start at different times causing an annoying flicker effect and conveying an impression of faulty lamps or circuit. While the lamps 11, 12 are operating, their current, and the current in the ballast inductor 21, is relatively lower (such as about 66%) than the cathode preheat current and only a smaller amount of voltage is induced in the secondary winding 24 and hence an insignificant amount of current is provided by winding 24 to the cathodes 13, 14. Thus, the system efficiency is improved because little heating current power is applied to the cathodes during lamp operation.

More than two lamps may be connected in series, utilizing the principles of the invention, using a single starter 23 across the outermost cathodes and employing additional secondary windings 24 connected to preheat the additional pairs of parallel-connected lamp cathodes. Additional starting capacitors 26 would be provided for the additional lamps in well-known manner.

The voltage characteristics of the lamps should be chosen for proper operation of the system on the aforesaid line voltage of about 200 to 300 volts at input terminals 17, 18. For example, the lamps 11, 12 may each be a 48-inch long 34-watt low energy lamp operating at a power consumption of less than ten watts per foot of lamp length and having an outside diameter of about one and one-half inches, the lamps being devoid of any internal conductive starting aid material therealong and containing a gas fill of mercury vapor and a mixture of krypton and neon or argon in a volume ratio of about 80% to 20% at a pressure of about 1.5 torr. It is only with the use of these 48" low energy type lamps that satisfactory two lamp starting can be achieved at the mentioned line voltages. Furthermore, the ratio of lamp volt to open circuit volts should not exceed 0.8 to assure the starting reliability.

The invention has been found to achieve its desirable objectives of providing simultaneous starting of a pair of 48-inch fluorescent lamps in a multiple lamp system operating from a line voltage of 200 to 300 volts. The invention can employ more than two lamps, for example four shorter lamps, in electrical series, having a total lamp length of about 96 inches as do a pair of 48-inch lamps and otherwise having the characteristics defined above.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A fluorescent lamp lighting system for operation from an a-c voltage source in the range of about 200 to 300 volts at a frequency of about 50 to 60 hertz, comprising:

two or more series connected fluorescent lamps, each lamp having an electron emissive filament disposed within said lamp at each respective end thereof, and each said filament having first and second ends extending from said lamp for electrical connection; respective first and second ends of the respective filaments disposed at respective ends of consecutive ones of said lamps disposed proximate to each other being connected in series to provide a series combination of lamps with a total lamp length of about 96 inches; each of said lamps comprising a lamp bulb having an outside diameter of about one and one-half inches, each said bulb being devoid of any internal conductive starting aid material therealong and containing a gas fill of mercury vapor and a mixture of krypton and neon or argon in a volume ratio of about 80% to 20% at a pressure of about 1.5 torr, connection means for connecting said series combination across said a-c voltage source; said connection means comprising first electrical conductor means for connecting a first end of a filament at one end of one of said lamps at one distal end of said series combination to a first terminal of said a-c voltage source and second electrical conductor means for connecting a first end of a filament at one end of one of said lamps at the opposite distal end of said series combination;

said first electrical conductor means including a series connected ballast comprising an inductor and a capacitor connected in electrical series and adapted to operate said lamps at a power consumption of less than ten watts per foot of lamp length;

glow switch type starter switch means connected between a second end of said filament at said one distal end of said series combination and a second end of said filament at said opposite distal end of said series combination to provide preheat current to said filaments at said distal ends prior to starting of said lamps;

secondary winding means coupled to said ballast inductor and connected to the respective ends of said filaments at said proximate ends of said consecutive ones of said lamps to provide preheat current to said filaments prior to starting of said lamps; and starting capacitor means connected across one of said lamps.

2. A lighting system as claimed in claim 1, in which said secondary winding means further comprises means for supplying preheat current to said filaments at said proximate ends of said consecutive ones of said lamps prior to starting of said lamps and a substantially lower amount of current to said filaments at said proximate ends when said lamps are operating than the value of said preheat current.

3. A lighting system as claimed in claim 1, in which said filaments at said proximate ends of said consecutive ones of said lamps are in electrical parallel.

4. A lighting system as claimed in claim 1, in which said starter switch means comprises means for connecting said filaments at said distal ends of said consecutive ones of said lamps in electrical series prior to said starting of said lamps.

5. A lighting system as claimed in claim 1, in which said total lamp length is comprised of two lamps connected in electrical series and each having a length of about 48 inches.

* * * * *